US012264544B2

(12) United States Patent
Zhao et al.

(10) Patent No.: US 12,264,544 B2
(45) Date of Patent: Apr. 1, 2025

(54) DOWNHOLE TRACTION SYSTEM

(71) Applicant: Chengdu University of Technology, Chengdu (CN)

(72) Inventors: Jianguo Zhao, Chengdu (CN); Qingyou Liu, Chengdu (CN); Haiyan Zhu, Chengdu (CN); Min Wan, Chengdu (CN); Guorong Wang, Chengdu (CN); Xuecheng Dong, Chengdu (CN); Xu Luo, Chengdu (CN); Yingju Pei, Chengdu (CN); Xingming Wang, Chengdu (CN)

(73) Assignee: Chengdu University of Technology, Chengdu (CN)

( * ) Notice: Subject to any disclaimer, the term of this patent is extended or adjusted under 35 U.S.C. 154(b) by 0 days.

(21) Appl. No.: 18/508,923

(22) Filed: Nov. 14, 2023

(65) Prior Publication Data

US 2024/0360733 A1 Oct. 31, 2024

(30) Foreign Application Priority Data

Apr. 28, 2023 (CN) ..... 202310475101.3
Apr. 28, 2023 (CN) ..... 202310477882.X
Apr. 28, 2023 (CN) ..... 202310477889.1

(51) Int. Cl.
*E21B 23/00* (2006.01)
*E21B 23/14* (2006.01)
(Continued)

(52) U.S. Cl.
CPC ..... *E21B 23/001* (2020.05); *E21B 23/14* (2013.01); *E21B 47/06* (2013.01); *E21B 47/09* (2013.01); *E21B 47/13* (2020.05)

(58) Field of Classification Search
CPC ..... E21B 23/001; E21B 47/06; E21B 47/09; E21B 47/13
See application file for complete search history.

(56) References Cited

U.S. PATENT DOCUMENTS

2005/0145415 A1* 7/2005 Doering ..... E21B 4/18 175/24
2013/0068479 A1* 3/2013 AIDossary ..... E21B 4/18 166/381

(Continued)

FOREIGN PATENT DOCUMENTS

CN 102140912 A 8/2011
CN 102777145 A 11/2012
CN 112879362 A 6/2021

*Primary Examiner* — Brad Harcourt

(57) ABSTRACT

A downhole traction system includes a driving system and a downhole wheeled tractor. The driving system is connected with the downhole wheeled tractor; the downhole wheeled tractor comprises a tractor body, a power unit and a plurality of traction units; the plurality of traction units are arranged along the extension direction of the tractor body; each of the traction units comprises a driving arm, a supporting arm, a supporting wheel, a driving assembly and a supporting assembly; the driving arm and the supporting arm are movably connected with the tractor body; and the supporting wheel is connected with the driving arm and the supporting arm. When the supporting assembly drives the supporting arm to extend along the radial direction of the tractor body under the hydraulic drive action of the hydraulic power unit, the supporting wheel can be abutted against the well wall.

19 Claims, 7 Drawing Sheets

(51) Int. Cl.

| | |
|---|---|
| ***E21B 47/06*** | (2012.01) |
| ***E21B 47/09*** | (2012.01) |
| ***E21B 47/13*** | (2012.01) |

(56) References Cited

U.S. PATENT DOCUMENTS

| | | | | |
|---|---|---|---|---|
| 2016/0362953 | A1* | 12/2016 | Bedrossian | E21B 4/18 |
| 2020/0141506 | A1* | 5/2020 | Holder | E21B 34/10 |
| 2022/0275692 | A1* | 9/2022 | Al-Mousa | E21B 41/0085 |
| 2023/0175320 | A1* | 6/2023 | Andersen | E21B 23/14 175/257 |

* cited by examiner

DOWNHOLE TRACTION SYSTEM

This patent application requests the priority of the following patent applications: 1. application number: CN202310477882.X, application date: Apr. 28, 2023, and patent application title: a downhole wheeled tractor and system; 2. application number: CN202310477889.1, application date: Apr. 28, 2023, and patent application title: a mud driven downhole traction system; and 3. application number: CN202310475101.3, application date: Apr. 28, 2023, and patent application title: a gas driving system of a downhole wheeled tractor. All the contents of the above patent applications are quoted in this patent application document.

TECHNICAL FIELD

The present invention relates to the field of oil and gas development equipment, and relates to a wheeled tractor, in particular to a downhole traction system.

BACKGROUND OF THE PRESENT INVENTION

In recent years, in order to reduce the cost of oil and natural gas exploitation, the horizontal drilling technology has been widely used for the exploitation of deep oil reserves.

At present, horizontal wells are widely used in the development of oil and gas resources in China and abroad, and related technologies of the horizontal wells also become increasingly important. In the stages of logging, etc., related instruments and other tools often need to be lowered into the horizontal wells for the operation of measurement. In the oil industry, a downhole tractor (downhole towing system) is widely used for tool delivery, downhole monitoring and construction operation in the horizontal wells.

Downhole tractors can be classified into three categories according to the mode of movement: wheeled tractors, retractable tractors and crawler tractors. The wheeled tractors are widely used in the oil industry because of the advantages of simple structure and high speed. However, the wheeled tractors have the disadvantage of small traction, and the existing drive mode has many problems of control inconvenience, and high cost of use and maintenance.

SUMMARY OF PRESENT INVENTION

The present application provides a downhole wheeled traction system to solve the above problems.

The present invention is specifically as follows:

A downhole traction system comprises a driving system and a downhole wheeled tractor; the driving system is connected with the downhole wheeled tractor; the downhole wheeled tractor comprises a tractor body, a power unit and a plurality of traction units; the plurality of traction units are arranged along the extension direction of the tractor body; each of the traction units comprises a driving arm, a supporting arm, a supporting wheel, a driving assembly and a supporting assembly; the driving arm and the supporting arm are movably connected with the tractor body; and the supporting wheel is connected with the driving arm and the supporting arm.

The driving assembly is in transmission connection with the supporting wheel; the supporting assembly is in transmission connection with the supporting arm, and the driving assembly and the supporting assembly are connected with a hydraulic power unit;

The driving assembly is used for driving the supporting wheel to rotate under the hydraulic drive action of the hydraulic power unit; and the supporting assembly is used for driving the supporting arm to radially extend along the tractor body under the hydraulic drive action of the hydraulic power unit, so that the supporting wheel connected with the supporting arm is abutted against a well wall, or for driving the supporting arm to radially retract along the tractor body, so that the supporting wheel connected with the supporting arm is stored in the tractor body and not abutted against the well wall.

Moreover, the driving assembly comprises a first hydraulic bidirectional motor and a mechanical transmission mechanism, the first hydraulic bidirectional motor is connected with the hydraulic power unit, and the mechanical transmission mechanism is in transmission connection with the first hydraulic bidirectional motor and the supporting wheel;

The first hydraulic bidirectional motor is used for driving the supporting wheel through the mechanical transmission mechanism to rotate under the hydraulic drive action of the hydraulic power unit.

Moreover, the supporting assembly comprises a second hydraulic bidirectional motor and a supporting and regulating mechanism; the second hydraulic bidirectional motor is connected with the hydraulic power unit; and the supporting and regulating mechanism is in transmission connection with the second hydraulic bidirectional motor and the supporting arm;

The second hydraulic bidirectional motor is used for driving the supporting arm to extend or retract relative to the tractor body through the supporting and regulating mechanism under the hydraulic drive action of the hydraulic power unit.

Moreover, the hydraulic power unit comprises a hydraulic power module, a wireless PLC module, and a downhole measurement and control module;

The hydraulic power module is connected with the driving assembly and the supporting assembly through the downhole measurement and control module, and the hydraulic power module is used for conveying pressurized hydraulic oil to the driving assembly and the supporting assembly through the downhole measurement and control module.

The wireless PLC module is electrically connected with the hydraulic power module and the downhole measurement and control module, and the wireless PLC module is used for communication connection with external equipment.

Moreover, the hydraulic power module comprises a hydraulic oil tank, an oil filter, a hydraulic motor and a hydraulic pump;

The hydraulic pump is communicated with the hydraulic oil tank through the oil filter, and the hydraulic motor is in transmission connection with the hydraulic pump and is used for driving the hydraulic pump to operate to pressurize the hydraulic oil in the hydraulic oil tank and pump into the downhole measurement and control module.

Moreover, the downhole measurement and control module comprises a first hydraulic pipeline, a second hydraulic pipeline, a first electromagnetic multi-way reversing valve, a second electromagnetic multi-way reversing valve, a first check valve and a second check valve;

One end of the first hydraulic pipeline is communicated with the hydraulic pump, and the other end of the first hydraulic pipeline is communicated with P port of the first electromagnetic multi-way reversing valve; T port of the first electromagnetic multi-way reversing valve is communicated with the hydraulic oil tank; and A port and B port of the first electromagnetic multi-way reversing valve are communicated with the driving assembly;

One end of the second hydraulic pipeline is communicated with the hydraulic pump, and the other end of the second hydraulic pipeline is communicated with P port of the second electromagnetic multi-way reversing valve; T port of the second electromagnetic multi-way reversing valve is communicated with the hydraulic oil tank; and A port and B port of the second electromagnetic multi-way reversing valve are communicated with the supporting assembly;

The first check valve is arranged on the first hydraulic pipeline to conduct the first hydraulic pipeline in one direction from the hydraulic pump to the first electromagnetic multi-way reversing valve, and the second check valve is arranged on the second hydraulic pipeline to conduct the second hydraulic pipeline in one direction from the hydraulic pump to the second electromagnetic multi-way reversing valve.

Moreover, the first electromagnetic multi-way reversing valve and the second electromagnetic multi-way reversing valve are Y-type three-position four-way electromagnetic reversing valves, and the A port and the B port of the first electromagnetic multi-way reversing valve and the second electromagnetic multi-way reversing valve are communicated with the T ports after power failure.

Moreover, the downhole measurement and control module further comprises a pressure sensor and a flow sensor; the pressure sensor is used for detecting the oil pressure of hydraulic oil outputted by the hydraulic pump, and the flow sensor is used for detecting the flow of hydraulic oil outputted by the hydraulic pump.

Moreover, the downhole wheeled tractor comprises a plurality of traction units; the plurality of traction units are arranged along the extension direction of the tractor body; and the plurality of traction units are connected with the hydraulic power unit.

A downhole wheeled traction system comprises a ground PLC control unit, a cable device, a ground measurement and control device and the downhole wheeled tractor.

The ground measurement and control device is electrically connected with the ground PLC control unit, and the ground PLC control unit is electrically connected with the downhole wheeled tractor through the cable device.

The technical solution when the driving system adopts a pneumatic driving system is as follows:

A downhole traction system comprises a driving system and a downhole wheeled tractor; the driving system is connected with the downhole wheeled tractor; the downhole wheeled tractor comprises a tractor body, a power unit and a plurality of traction units; the plurality of traction units are arranged along the extension direction of the tractor body; each of the traction units comprises a driving arm, a supporting arm, a supporting wheel, a driving assembly and a supporting assembly; the driving arm and the supporting arm are movably connected with the tractor body; and the supporting wheel is connected with the driving arm and the supporting arm. The power unit comprises an optical fiber nipple, a downhole measurement and control module, and a downhole control nipple; an optical transmitter and a PCM electrical transceiver are installed in the optical fiber nipple; a downhole pressure sensor, a downhole speed sensor and a downhole displacement sensor are installed in the downhole measurement and control module; and the downhole control nipple is composed of a liquid storage tank, a control module and an exhaust port.

The pneumatic driving system is composed of a ground gas compressor, a gas booster pump, a gas regulation module, a gas recovery station, an optical fiber device, an optical fiber receiving module, a ground optical fiber monitoring module, a downhole valve group control module, and a downhole wheeled tractor; the ground gas compressor is connected with the gas booster pump; the gas booster pump is connected with the gas regulation module; the gas regulation module transmits the gas to the downhole wheeled tractor through a conveying pipeline A; a gas driving system of the downhole wheeled tractor uses an optical fiber to transmit measurement and control signals; the optical fiber device extends into the downhole wheeled tractor through the optical fiber; the optical fiber device is connected with the optical fiber receiving module; and the ground optical fiber monitoring module is connected with the optical fiber receiving module and the gas regulation module through signals.

The ground gas compressor provides a high pressure gas source and pressurizes the gas through the gas booster pump. The gas regulation module can regulate the pressure and flow parameters of the output gas.

An optical transmitter and a PCM electrical transceiver are installed in an optical fiber nipple; a downhole pressure sensor, a downhole speed sensor and a downhole displacement sensor are installed in the downhole measurement and control module; three sensors as signal sources transmit signals to the optical fiber receiving module through the optical fiber by the PCM electrical transceiver and the optical transmitter; and the ground optical fiber monitoring module monitors the pressure, the speed and the displacement of the downhole wheeled tractor.

The downhole control nipple is composed of a liquid storage tank, a control module and an exhaust port; the exhaust port is connected with the gas recovery station through a conveying pipeline B to recover gas; and the traction unit is composed of a hydraulic bidirectional motor, a transmission mechanism, a driving arm, a driving wheel, a supporting arm, a supporting and regulating mechanism and a hydraulic cylinder.

The control module is composed of a pneumatic liquid booster pump, an overflow valve, a three-position four-way electromagnetic reversing valve, a two-position three-way electromagnetic reversing valve and adjustable one-way throttle valves, and the number of the adjustable one-way throttle valves is 2; the adjustable one-way throttle valve B is connected in series with the two-position three-way electromagnetic reversing valve, and the adjustable one-way throttle valve B and the two-position three-way electromagnetic reversing valve are connected in parallel with the adjustable one-way throttle valve A; and the above three valves, the overflow valve and the three-position four-way electromagnetic reversing valve are connected in parallel.

The gas enters the pneumatic liquid booster pump through a gas inlet of the pneumatic liquid booster pump, to drive the hydraulic oil in the liquid storage tank to enter the pneumatic liquid booster pump.

The downhole valve group control module is connected with the control module through a signal, and can control the operating state of a valve group therein; a differential circuit is formed between the two-position three-way electromagnetic reversing valve and the hydraulic cylinder; and the adjustable one-way throttle valves are installed in an inlet and an outlet of the hydraulic cylinder, to play the role of exhaust throttling and adjust the expansion speed of the hydraulic cylinder, so as to achieve a better adjustment role.

When the driving system is a mud driving system, a downhole traction system comprises a driving system and a downhole wheeled tractor; the driving system is connected with the downhole wheeled tractor; the downhole wheeled tractor comprises a tractor body, a power unit and a plurality of traction units; the plurality of traction units are arranged along the extension direction of the tractor body; each of the traction units comprises a driving arm, a supporting arm, a supporting wheel, a driving assembly and a supporting assembly; the driving arm and the supporting arm are movably connected with the tractor body; and the supporting wheel is connected with the driving arm and the supporting arm. The downhole traction system comprises a mud station, a mud pump, a ground mud control module, a mud conveying pipeline and a downhole wheeled tractor; and the power unit comprises a control valve group, a downhole pressure sensor, a downhole speed sensor, a downhole displacement sensor and a mud continuous wave generator.

A mud inlet of the mud pump is communicated with the mud station; a mud outlet of the mud pump is communicated with the ground mud control module; and both ends of the mud conveying pipeline are communicated with the ground mud control module and the downhole wheeled tractor respectively.

The mud pump is used for pressurizing the mud in the mud station and then delivering the mud to the ground mud control module; the ground mud control module is used for controlling the pressure and the flow of the pressurized mud conveyed into the downhole wheeled tractor through the mud conveying pipeline; and the downhole wheeled tractor is used for downhole movement under the action of the conveyed pressurized mud.

Moreover, the ground mud control module comprises an overflow valve and a throttle valve; the overflow valve is used for controlling the pressure of the pressurized mud conveyed into the downhole wheeled tractor to control the traction force of the downhole wheeled tractor; and the throttle valve is used for controlling the flow of the pressurized mud conveyed into the downhole wheeled tractor to control the speed of the downhole wheeled tractor.

Moreover, the mud driven downhole traction system further comprises a ground monitoring device;

The downhole pressure sensor, the downhole speed sensor, the downhole displacement sensor and the mud continuous wave generator are all connected with the downhole wheeled tractor; the downhole pressure sensor is used for detecting the pressure of the downhole wheeled tractor; the downhole speed sensor is used for detecting the speed of the downhole wheeled tractor; and the downhole displacement sensor is used for detecting the displacement of the downhole wheeled tractor.

The mud continuous wave generator is electrically connected with the downhole pressure sensor, the downhole speed sensor and the downhole displacement sensor, and the mud continuous wave generator is in communication connection with the ground monitoring device; and the mud continuous wave generator is used for transmitting the pressure, speed and displacement data of the downhole wheeled tractor to the ground monitoring device.

Moreover, the mud driven downhole traction system further comprises a mud recovery station and a mud recovery pipe; one end of the mud recovery pipe is communicated with the mud recovery station, and the other end of the mud recovery pipe is communicated with a horizontal well; the mud recovery pipe is used for conveying the mud in the horizontal well into the mud recovery station; and the mud recovery station is communicated with a mud station pipeline.

Moreover, the mud driven downhole traction system further comprises an on-off valve, and the on-off valve is arranged on the pipeline that communicates the mud recovery station and the mud station.

Moreover, along the extension direction of the downhole wheeled tractor, one end of the downhole wheeled tractor is connected with the mud conveying pipeline, and the other end of the downhole wheeled tractor is provided with a mud discharge port.

Moreover, the downhole wheeled tractor comprises a tractor body, a mud power unit and a plurality of traction units.

The control valve group and the plurality of traction units are connected with the tractor body; the plurality of traction units are communicated with the mud conveying pipeline through the control valve group; and the control valve group is used for controlling the pressure and the flow direction of the pressurized mud conveyed into the plurality of traction units.

The present invention has the following beneficial effects:

The driving arm and the supporting arm of the downhole wheeled tractor provided by the present invention are movably connected with the tractor body; and the supporting assembly is used for driving the supporting arm to radially extend along the tractor body under the hydraulic drive action of the hydraulic power unit, so that the supporting wheel connected with the supporting arm is abutted against a well wall, or for driving the supporting arm to radially retract along the tractor body, so that the supporting wheel connected with the supporting arm is stored in the tractor body and not abutted against the well wall.

In the process of downhole use of the downhole wheeled tractor provided by the present invention, each traction unit comprises the driving arm and the supporting arm which are movably connected with the tractor body, and the driving assembly is in transmission connection with the supporting wheel; the supporting assembly is in transmission connection with the supporting arm; and the driving assembly and the supporting assembly are connected with the power unit. Therefore, under the hydraulic drive action of the power unit, the supporting arm and the driving arm can be driven to act relative to the tractor body. When the supporting assembly drives the supporting arm to extend along the radial direction of the tractor body under the hydraulic drive action of the hydraulic power unit, the supporting wheel can be abutted against the well wall. At the same time, the driving assembly can drive the supporting wheel to rotate under the hydraulic drive action of the hydraulic power unit, so that the downhole wheeled tractor moves in the downhole.

The downhole wheeled tractor provided by the present invention can provide the driving force for the plurality of traction units through a variety of power units. Through the power units, the supporting arm and the driving arm can be driven to act relative to the tractor body, so as to facilitate the adjustment of the abutting state between the supporting wheel and the well wall and the rotation state of the supporting wheel. Not only the downhole traction force of the downhole wheeled tractor is improved, but also the stability of operation is improved and good adaptability to the downhole environment is realized. Wherein the ground mud control module can control the pressure and the flow of the pressurized mud conveyed into the downhole wheeled tractor through the mud conveying pipeline, to improve the space utilization rate of the downhole wheeled tractor and reduce the operating cost of the mud driven downhole traction system. After the ground part of the gas driving system adopts a ground compressor and the ground gas booster pump and is adjusted by the gas regulation module, the ground uses pneumatic transmission to reduce the cost and responds quickly, has excellent operating environment adaptability, and can avoid the situation that the supporting wheel cannot be recovered during power failure or loss of control.

DESCRIPTION OF THE DRAWINGS

To more clearly describe the technical solutions in the embodiments of the present application, the drawings required to be used in embodiments will be simply presented below. It shall be understood that the following drawings only show some embodiments of the present application, and thus shall not be regarded as limitations to the scope. For those ordinary skilled in the art, other related drawings can also be obtained according to these drawings without contributing creative labor.

Figure 1:
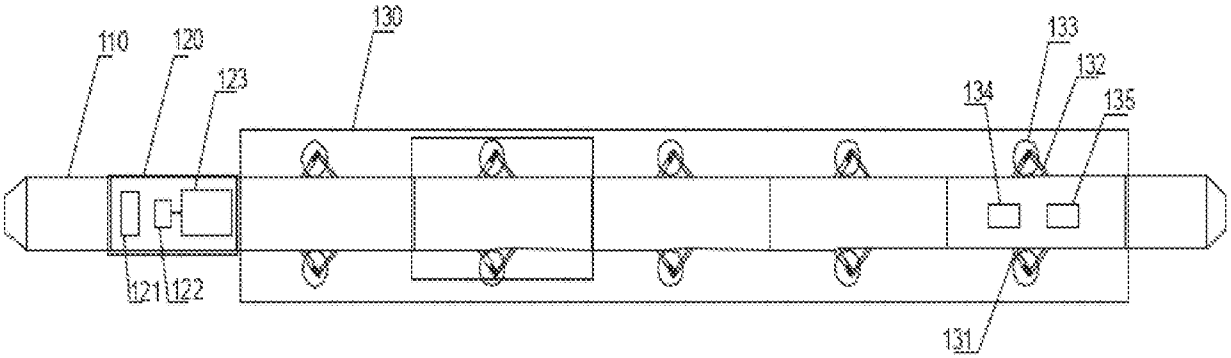
FIG. 1 is a structural schematic diagram of a downhole wheeled tractor provided by the present application.

In the figures: 100—downhole wheeled tractor; 110—tractor body; 120—power unit; 130—traction unit; 131—driving arm; 132—supporting arm; 133—supporting wheel; 134—driving assembly; 135—supporting assembly; 136—first hydraulic bidirectional motor; 137—mechanical transmission mechanism; 138—second hydraulic bidirectional motor; 139—supporting and regulating mechanism; 121—hydraulic power module; 122—wireless PLC module; 123—downhole measurement and control module; 124—hydraulic oil tank; 125—oil filter; 126—hydraulic motor; 127—hydraulic pump; 128—first hydraulic pipeline; 129—second hydraulic pipeline; 141—first electromagnetic multi-way reversing valve; 142—second electromagnetic multi-way reversing valve; 143—first check valve; 144—second check valve; 145—pressure sensor; 146—flow sensor; 147—overflow valve; 200—downhole wheeled traction system; 210—ground PLC control unit; 220—cable device; 230—ground measurement and control device;

1—ground gas compressor; 2—ground gas booster pump; 3—gas regulation module; 4—conveying pipeline A; 5—conveying pipeline B; 6—gas recovery station; 7—optical fiber; 8—optical fiber device; 9—optical fiber receiving module; 10—ground optical fiber monitoring module; 11—downhole valve group control module; 13—optical fiber connector; 14—optical fiber nipple; 15—optical transmitter; 16—PCM electrical transceiver; 18—downhole pressure sensor; 19—downhole speed sensor; 20—downhole displacement sensor; 21—downhole control nipple; 22—liquid storage tank; 23—control module; 24—exhaust port; 130—traction unit; 26—hydraulic bidirectional motor; 27—transmission mechanism; 131—driving arm; 133—driving wheel; 132—supporting arm; 31—supporting and regulating mechanism; 32—hydraulic cylinder; 33—pressure balancing module; 34—instrument connector; 35—pneumatic hydraulic booster pump; 147—overflow valve; 37—three-position four-way electromagnetic reversing valve; 38—two-position three-way electromagnetic reversing valve; 39—adjustable one-way throttle valve; 39*a*—adjustable one-way throttle valve A; 39*b*—adjustable one-way throttle valve B;

N11—mud station; N12—mud pump; N13—ground mud control module; N14—mud conveying pipeline; N16—overflow valve; N17—throttle valve; N21—mud continuous wave generator; N22—ground monitoring device; N23—mud recovery station; N24—mud recovery pipe; N25—on-off valve; N26—mud discharge port; N28—control valve group; 30—mud return pipe.

DETAILED DESCRIPTION OF PREFERRED EMBODIMENTS

To make the purpose, the technical solutions and advantages of the embodiments of the present application more clear, the technical solutions in the embodiments of the present application will be clearly and fully described below in combination with the drawings in the embodiments of the present application. Apparently, the described embodiments are merely part of the embodiments of the present application, not all of the embodiments. The assemblies of the embodiments of the present application described and shown in the drawings herein may be generally arranged and designed in various different configurations.

Therefore, the following detailed description of the embodiments of the present application provided in the drawings is not intended to limit the scope of the claimed present application, and merely represents the selected embodiments of the present application. Based on the embodiments in the present application, all other embodiments obtained by those ordinary skilled in the art without contributing creative labor will belong to the protection scope of the present application.

It should be explained that if there is no conflict, the embodiments in the present application and the features in the embodiments can be mutually combined.

It should be noted that similar reference signs and letters indicate similar items in the following drawings. Therefore, a certain item will not be further defined and explained in the subsequent drawings once defined in one drawing.

Embodiment 1

Figure 2:
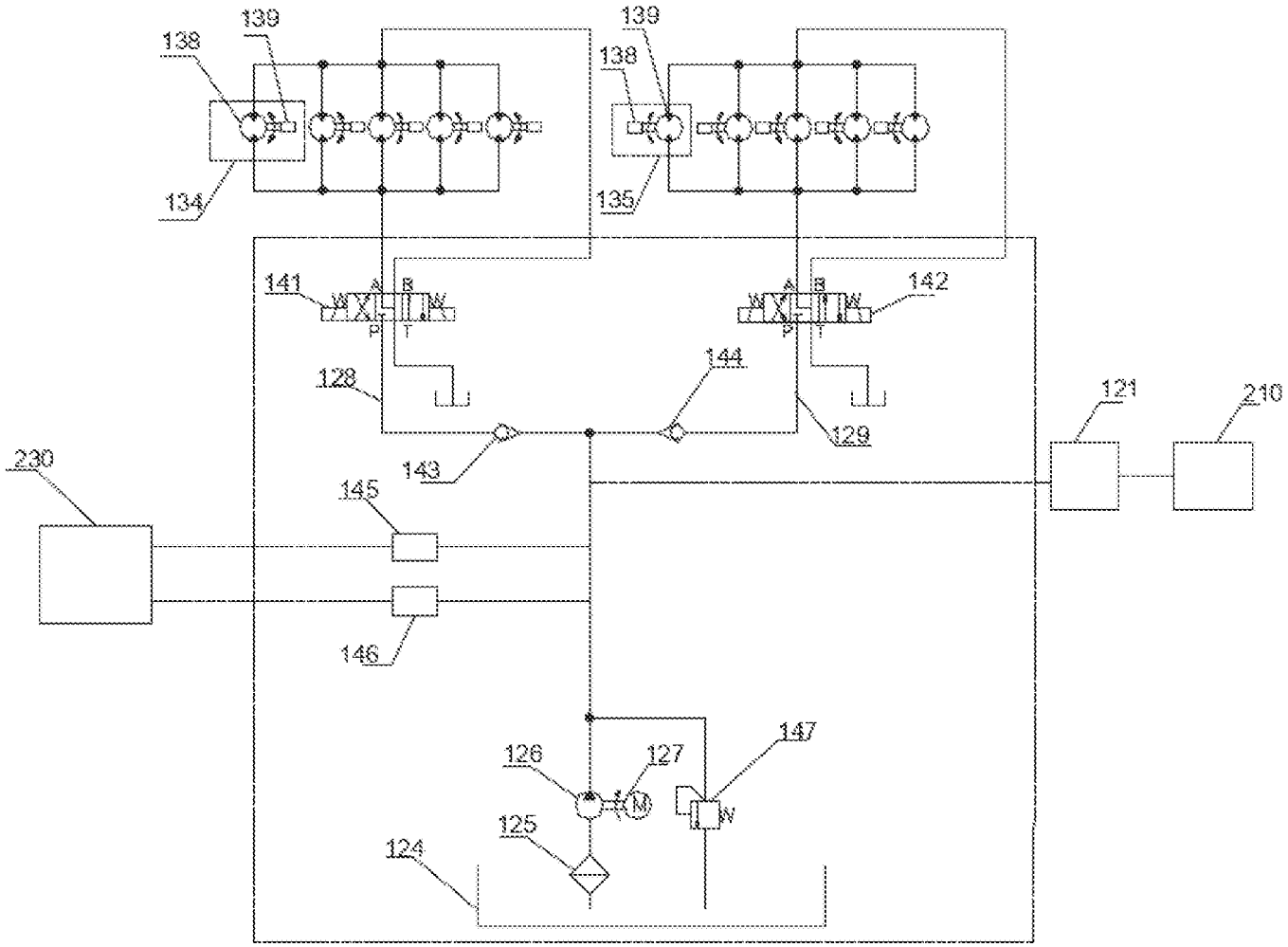
FIG. 2 is a structural schematic diagram of a hydraulic power unit provided by the present application.

By referring to FIG. 1 and FIG. 2, the present embodiment provides a downhole wheeled tractor 100 and a downhole traction system; the downhole wheeled tractor 100 comprises a tractor body 110, a hydraulic power unit 120 and a plurality of traction units 130.

The plurality of traction units 130 are arranged along the extension direction of the body; each of the traction units 130 comprises a driving arm 131, a supporting arm 132, a supporting wheel 133, a driving assembly 134 and a supporting assembly 135; the driving arm 131 and the supporting arm 132 are movably connected with the body; and the supporting wheel 133 is connected with the driving arm 131 and the supporting arm 132.

The driving assembly 134 is in transmission connection with the supporting wheel 133; the supporting assembly 135 is in transmission connection with the supporting arm 132, and the driving assembly 134 and the supporting assembly 135 are connected with the hydraulic power unit 120.

The driving assembly 134 is used for driving the supporting wheel 133 to rotate under the hydraulic drive action of the hydraulic power unit 120; and the supporting assembly 135 is used for driving the supporting arm 132 to radially extend along the body under the hydraulic drive action of the hydraulic power unit 120, so that the supporting wheel 133 connected with the supporting arm 132 is abutted against a well wall, or for driving the supporting arm 132 to radially retract along the body, so that the supporting wheel 133 connected with the supporting arm 132 is stored in the body and not abutted against the well wall.

By referring to FIG. 1 and FIG. 2, the operating principle of the downhole wheeled tractor 100 is as follows:

The downhole wheeled tractor 100 can provide driving force for the plurality of traction units 130 through the hydraulic power unit 120 in the process of downhole use, so as to drive the traction units 130 to operate in the downhole. Because each of the traction units 130 comprises a driving arm 131 and a supporting arm 132 that are movably connected with the body, and the driving assembly 134 is in transmission connection with the supporting wheel 133, the supporting assembly 135 is in transmission connection with the supporting arm 132, and the driving assembly 134 and the supporting assembly 135 are connected with the hydraulic power unit 120.

Therefore, under the hydraulic drive action of the hydraulic power unit 120, the supporting arm 132 and the driving arm 131 can be driven to act relative to the body. Thus, when the supporting assembly 135 drives the supporting arm 132 to extend along the radial direction of the body under the hydraulic drive action of the hydraulic power unit 120, the supporting wheel 133 can be abutted against the well wall. At the same time, the driving assembly 134 can drive the supporting wheel 133 to rotate under the hydraulic drive action of the hydraulic power unit 120, so that the downhole wheeled tractor 100 moves in the downhole.

In this process, through the hydraulic power unit 120, the supporting arm 132 and the driving arm 131 can be driven to act relative to the body, so as to facilitate the adjustment of the abutting state between the supporting wheel 133 and the well wall and the rotation state of the supporting wheel 133. Not only the downhole traction force of the downhole wheeled tractor 100 is improved, but also the stability of operation is improved and good adaptability to the downhole environment is realized.

Further, by referring to FIG. 1 and FIG. 2, in the present embodiment, in order to enable the supporting arm 132 and the driving arm 131 to act relative to the body under the hydraulic drive action of the hydraulic power unit 120, that is, to drive the supporting wheel 133 to rotate under the hydraulic drive action of the hydraulic power unit 120, and to adjust the abutting state between the supporting wheel 133 and the well wall by the action of the supporting arm 132, the driving assembly 134 comprises a first hydraulic bidirectional motor 136 and a mechanical transmission mechanism 137. The first hydraulic bidirectional motor 136 is connected with the hydraulic power unit 120. The mechanical transmission mechanism 137 is in transmission connection with the first hydraulic bidirectional motor 136 and the supporting wheel 133; and the first hydraulic bidirectional motor 136 is used for driving the supporting wheel 133 through the mechanical transmission mechanism 137 to rotate under the hydraulic drive action of the hydraulic power unit 120.

The supporting assembly 135 comprises a second hydraulic bidirectional motor 138 and a supporting and regulating mechanism 139; the second hydraulic bidirectional motor 138 is connected with the hydraulic power unit 120; and the supporting and regulating mechanism 139 is in transmission connection with the second hydraulic bidirectional motor 138 and the supporting arm 132. The second hydraulic bidirectional motor 138 is used for driving the supporting arm 132 to extend or retract relative to the body through the supporting and regulating mechanism 139 under the hydraulic drive action of the hydraulic power unit 120.

It should be noted that the above contents are illustrated with the structure of one traction unit 130 as an example. In the present embodiment, the structural principles of the plurality of traction units 130 are the same, so the operating principles and structures of other traction units 130 are not explained. In addition, in the process of use, when the downhole wheeled tractor 100 is required to move in the downhole, the hydraulic power unit 120 needs to firstly adjust the position of the supporting arm 132 through the supporting and regulating mechanism 139, so that the supporting wheel 133 is abutted against the well wall. In the abutting state between the supporting wheel 133 and the well wall, the hydraulic power unit 120 drives the supporting wheel 133 to rotate for traction. Because the power source of the supporting wheel 133 is hydraulic, the structural volume of the downhole wheeled tractor 100 can be effectively reduced and the traction force can be improved.

Based on the above contents, it should be noted that by referring to FIG. 1 and FIG. 2, in the present embodiment, the plurality of traction units 130 are connected with the same hydraulic power unit 120, and the power sources of the plurality of traction units 130 are the same hydraulic source, with the purpose of simplifying the structural volume of the downhole wheeled tractor 100. When the hydraulic power unit 120 is arranged, to enable the hydraulic power unit 120 to provide hydraulic power stably for the plurality of traction units 130, the hydraulic power unit 120 can comprise a hydraulic power module 121, a wireless PLC module 122, and a downhole measurement and control module 123.

Wherein the hydraulic power module 121 is connected with the driving assembly 134 and the supporting assembly 135 through the downhole measurement and control module 123, and the hydraulic power module 121 is used for conveying pressurized hydraulic oil to the driving assembly 134 and the supporting assembly 135 through the downhole measurement and control module 123. The wireless PLC module 122 is electrically connected with the hydraulic power module 121 and the downhole measurement and control module 123, and the wireless PLC module 122 is used for communication connection with external equipment.

Thus, the hydraulic power module 121 can convey the pressurized hydraulic oil to the driving assembly 134 and the supporting assembly 135. Moreover, in the process of conveying, to control the conveyed hydraulic oil in the downhole operating state based on the downhole wheeled tractor 100, the measurement and control module is arranged. The transmission state of the hydraulic oil can be controlled through the measurement and control module, and meanwhile, the hydraulic oil conveyed to the driving assembly 134 and the supporting assembly 135 is controlled.

It should be noted that the wireless PLC module 122 is used for communication connection with external equipment, with the purpose of receiving a control signal of an external control system and transmitting the downhole operating state information of the downhole wheeled tractor 100 to the external control system.

When the hydraulic power module 121 is arranged, the hydraulic power module 121 comprises a hydraulic oil tank 124, an oil filter 125, a hydraulic motor 126 and a hydraulic pump 127. The hydraulic pump 127 is communicated with the hydraulic oil tank 124 through the oil filter 125, and the hydraulic motor 126 is in transmission connection with the hydraulic pump 127 and is used for driving the hydraulic pump 127 to operate to pressurize the hydraulic oil in the hydraulic oil tank 124 and pump into the downhole measurement and control module 123. It should be noted that the hydraulic power module 121 further comprises an overflow valve 147 communicated with the hydraulic oil tank 124.

Based on the arrangement of the above hydraulic power module 121, by referring to FIG. 1 and FIG. 2, the downhole measurement and control module 123 may comprise a first hydraulic pipeline 128, a second hydraulic pipeline 129, a first electromagnetic multi-way reversing valve 141, a second electromagnetic multi-way reversing valve 142, a first check valve 143 and a second check valve 144.

One end of the first hydraulic pipeline 128 is communicated with the hydraulic pump 127, and the other end of the first hydraulic pipeline 128 is communicated with P port of the first electromagnetic multi-way reversing valve 141; T port of the first electromagnetic multi-way reversing valve 141 is communicated with the hydraulic oil tank 124; and A port and B port of the first electromagnetic multi-way reversing valve 141 are communicated with the driving assembly 134.

One end of the second hydraulic pipeline 129 is communicated with the hydraulic pump 127, and the other end of the second hydraulic pipeline 129 is communicated with P port of the second electromagnetic multi-way reversing valve 142; T port of the second electromagnetic multi-way reversing valve 142 is communicated with the hydraulic oil tank 124; and A port and B port of the second electromagnetic multi-way reversing valve 142 are communicated with the supporting assembly 135.

The first check valve 143 is arranged on the first hydraulic pipeline 128 to conduct the first hydraulic pipeline 128 in one direction from the hydraulic pump 127 to the first electromagnetic multi-way reversing valve 141, and the second check valve 144 is arranged on the second hydraulic pipeline 129 to conduct the second hydraulic pipeline 129 in one direction from the hydraulic pump 127 to the second electromagnetic multi-way reversing valve 142.

Thus, through the above structural arrangement, the delivery control of the hydraulic oil of the driving assembly 134 and the supporting assembly 135 can be realized through the control of the first electromagnetic multi-way reversing valve 141 and the second electromagnetic multi-way reversing valve 142. In addition, because the supporting wheel 133 has forward rotation and reverse rotation in the process of rotation, the direction of the hydraulic oil conveyed to the driving assembly 134 can be adjusted through the arrangement of the first electromagnetic multi-way reversing valve 141 so that the supporting wheel 133 can adjust the rotation direction according to the traction demands. Similarly, because the action of the supporting arm 132 comprises extension and retraction, the direction of the hydraulic oil conveyed to the supporting assembly 135 can also be adjusted through the arrangement of the second electromagnetic multi-way reversing valve 142, so that the supporting arm 132 can adjust the position according to the traction demands to make the supporting wheel 133 abutted or not abutted against the well wall.

It should be noted that when the first electromagnetic multi-way reversing valve 141 and the second electromagnetic multi-way reversing valve 142 are arranged, because the T port of the first electromagnetic multi-way reversing valve 141 is communicated with the hydraulic oil tank 124, and the T port of the second electromagnetic multi-way reversing valve 142 is communicated with the hydraulic oil tank 124, the oil return ports of the first electromagnetic multi-way reversing valve 141 and the second electromagnetic multi-way reversing valve 142 are communicated with the hydraulic oil tank 124, so as to form a circulating oil circuit. In addition, when the first electromagnetic multi-way reversing valve 141 and the second electromagnetic multi-way reversing valve 142 are arranged, the first electromagnetic multi-way reversing valve 141 and the second electromagnetic multi-way reversing valve 142 are Y-type three-position four-way electromagnetic reversing valves. The purpose of this arrangement is to communicate the A port and the B port of the first electromagnetic multi-way reversing valve 141 and the second electromagnetic multi-way reversing valve 142 with the T ports after power failure. The purpose of this arrangement is to avoid the situation that the supporting wheel 133 cannot rotate and cause blockage in the case of power failure or loss of control, or the situation that the supporting arm 132 cannot be recovered.

Further, by referring to FIG. 1 and FIG. 2, to detect the transmission state of the hydraulic oil, the downhole measurement and control module 123 further comprises a pressure sensor 145 and a flow sensor 146; the pressure sensor 145 is used for detecting the oil pressure of the hydraulic oil outputted by the hydraulic pump 127, and the flow sensor 146 is used for detecting the flow of the hydraulic oil outputted by the hydraulic pump 127.

Based on the above structural arrangement, by referring to FIG. 1 and FIG. 2, in the present embodiment, the downhole wheeled tractor 100 comprises five traction units 130, a plurality of traction units 130 are arranged along the extension direction of the body, and the plurality of traction units 130 are connected with the hydraulic power unit 120.

Figure 3:
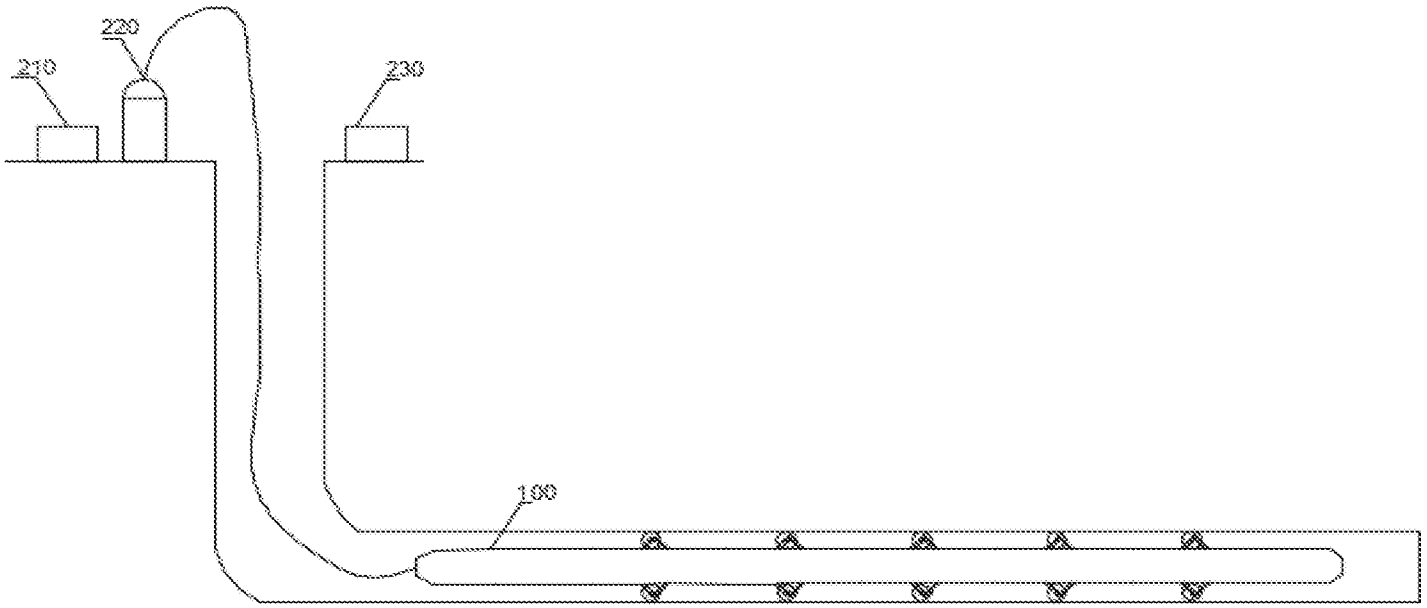
FIG. 3 is a structural schematic diagram of a downhole wheeled traction system which adopts a single motor driving system provided by the present application.
Figure 4:
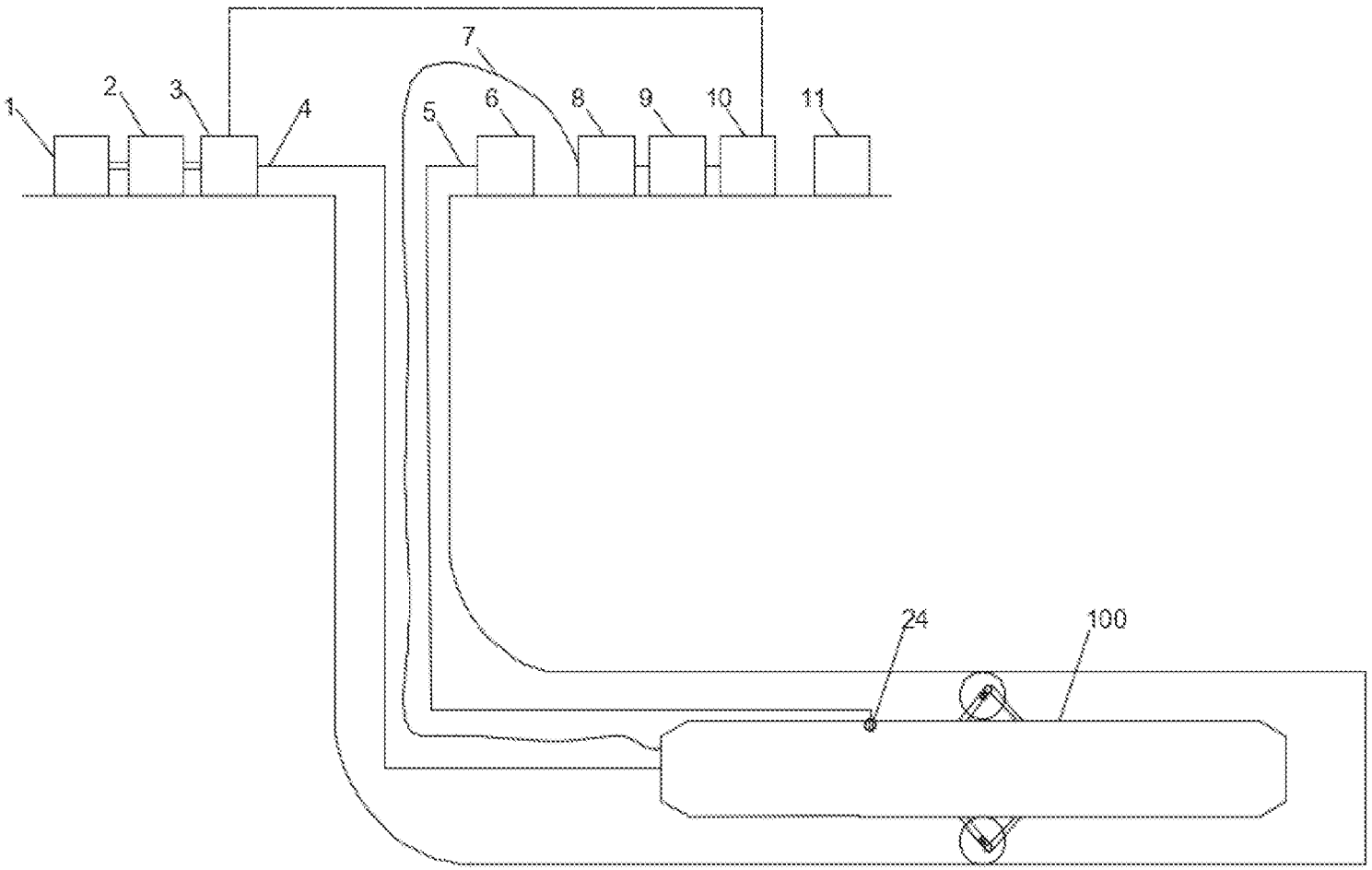
FIG. 4 is a structural schematic diagram of a downhole wheeled traction system which adopts a pneumatic driving system provided by the present application.
Figure 5:
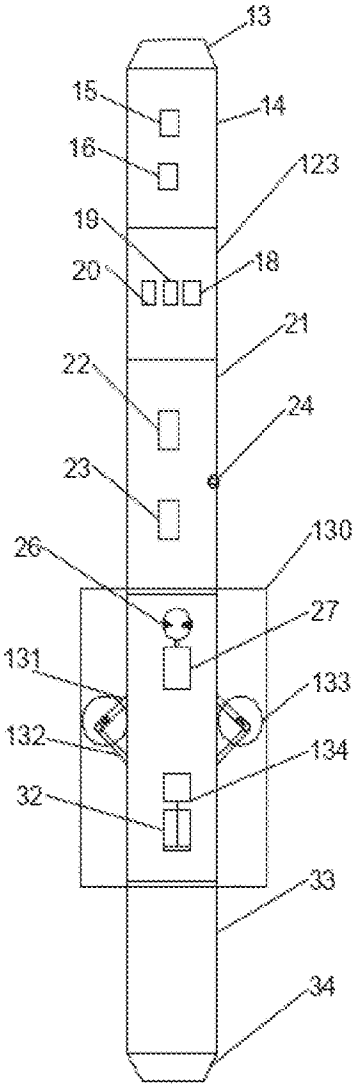
FIG. 5 is a structural schematic diagram of a downhole wheeled tractor which adopts a pneumatic driving system provided by the present application.
Figure 6:
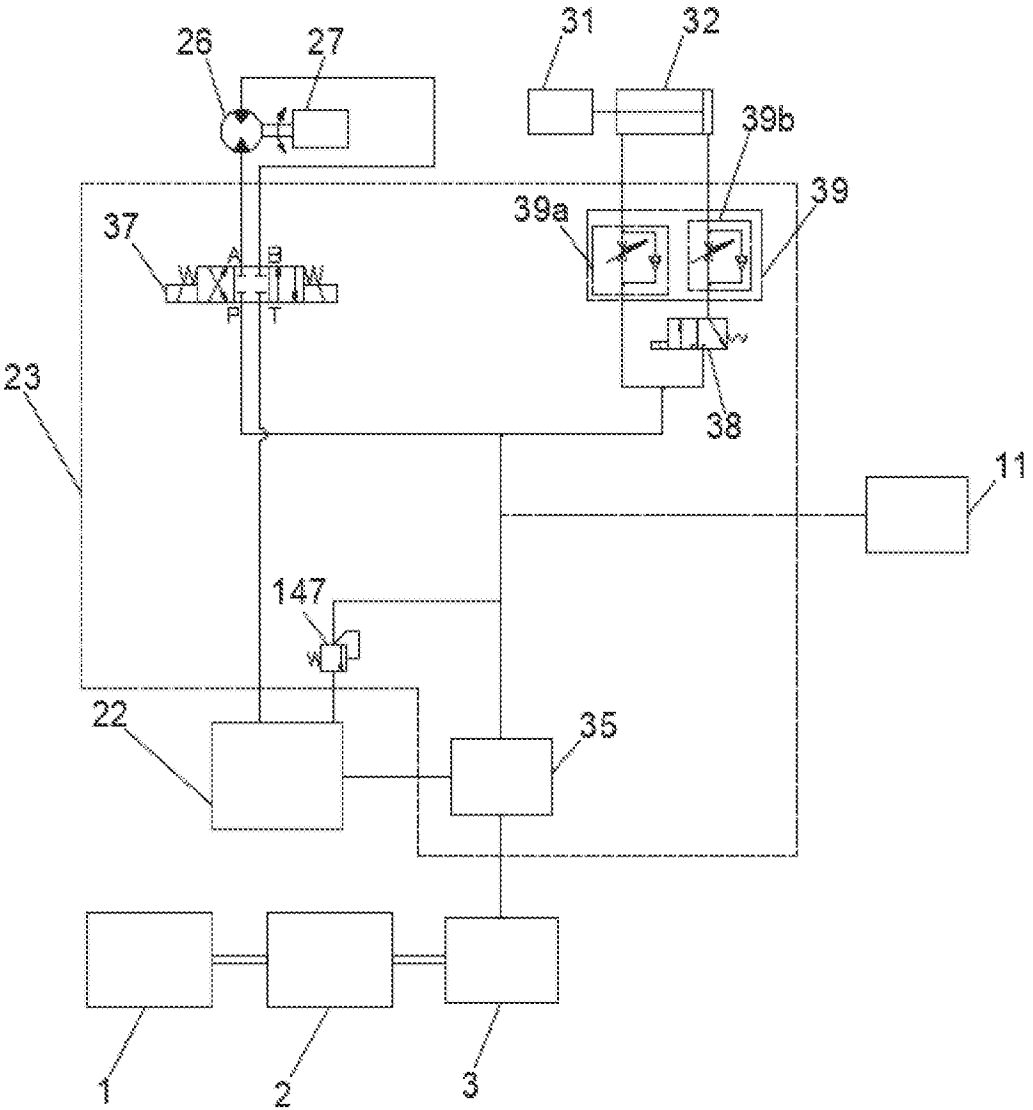
FIG. 6 is an electronic control circuit diagram of a downhole wheeled tractor which adopts a pneumatic driving system provided by the present application.

Based on the above contents, by referring to FIG. 1-FIG. 3, the present invention further provides a downhole wheeled traction system 200, which comprises a ground PLC control unit 210, a cable device 220, a ground measurement and control device 230 and the above downhole wheeled tractor 100.

The ground measurement and control device 230 is electrically connected with the ground PLC control unit 210, and the ground PLC control unit 210 is electrically connected with the downhole wheeled tractor 100 through the cable device 220. Moreover, the ground PLC control unit 210 is in communication connection with the wireless PLC module 122. Thus, through the ground PLC control unit 210, the hydraulic power unit 120 and the plurality of traction units 130 of the downhole wheeled tractor 100 can be controlled according to the needs of use.

By referring to FIG. 1-FIG. 3, the use steps of the downhole wheeled traction system 200 are as follows:

The downhole wheeled tractor 100 and a cable released by the cable device 220 are slowly lowered into a well;

When the downhole wheeled tractor 100 is placed horizontally in a horizontal well or an open hole well, the cable is energized to activate electrical components in the downhole wheeled tractor 100. Meanwhile, the ground PLC control unit 210 is activated and establishes communication connection with the wireless PLC module 122 to control the operating state of the downhole wheeled tractor 100.

Specifically, after the downhole wheeled tractor 100 enters the horizontal well or the open hole well fully horizontally, The ground PLC control unit 210 is connected with the wireless PLC module 122 through a wireless signal, so that the wireless PLC module 122 outputs the signal. Thus, the left electromagnet used for downhole measurement and control and the control of the second electromagnetic multi-way reversing valve 142 of the plurality of traction units 130 is powered to be in the left operating position. At this time, the second hydraulic bidirectional motor 138 rotates to drive the supporting and regulating mechanism 139, so that the supporting arm 132 extends along the radial direction of the body, and so that the supporting wheel 133 connected to the supporting arm 132 is close to the wall of the horizontal well or the open hole well.

Subsequently, the left electromagnet used for controlling the first electromagnetic multi-way reversing valve 141 is powered to be in the left operating position. At this time, the first hydraulic bidirectional motor 136 rotates forward, and the supporting wheel 133 is driven by the mechanical transmission mechanism 137 to rotate forward. The downhole wheeled tractor 100 moves forward.

When the downhole wheeled tractor 100 moves forward in the horizontal well, the test data of the pressure sensor 145 and the flow sensor 146 are transmitted to the ground PLC control unit 210 through the wireless PLC module 122. The traction force and the speed of the downhole wheeled tractor 100 can be measured through data conversion.

When the downhole wheeled tractor 100 needs to be retracted, the control signal is transmitted to the wireless PLC module 122 through the ground PLC control unit 210, and then the right electromagnet for controlling the first electromagnetic multi-way reversing valve 141 is powered to be in a right operating position. At this time, the first hydraulic bidirectional motor 136 rotates in reverse and the supporting wheel 133 is driven by the mechanical transmission mechanism 137 to rotate in reverse. The downhole wheeled tractor 100 retreats in reverse until the downhole wheeled tractor 100 retreats to an appropriate position.

After the downhole wheeled tractor 100 retreats to an appropriate position, the right electromagnet for controlling the second electromagnetic multi-way reversing valve 142 is powered to be in the right operating position. At this time, the second hydraulic bidirectional motor 138 rotates to drive the supporting and regulating mechanism 139, so that the supporting arm 132 is retracted along the radial direction of the body and so that the supporting wheel 133 connected to the supporting arm 132 is retracted in the direction of the body and not abutted against the well wall.

Then, the hydraulic motor 126 is stopped and the downhole wheeled tractor 100 is recovered.

In conclusion, the downhole wheeled traction system 200 has the following advantages:

The downhole wheeled tractor 100 can crawl in horizontal well by connecting the plurality of traction units 130 in series, and greater traction force can be provided for the downhole wheeled tractor 100 through the series connection of the plurality of traction units 130.

The downhole wheeled tractor 100 adopts the Y-type three-position four-way electromagnetic reversing valves to control the movement in the horizontal well. Therefore, the rational use of the first electromagnetic multi-way reversing valve 141 and the second electromagnetic multi-way reversing valve 142 can avoid the situation that the supporting wheel 133 is stuck in the well and the supporting wheel 133 cannot be retracted in the case of power failure and loss of control.

The ground PLC control unit 210 is used to control the downhole measurement and control and control the operating states of the first electromagnetic multi-way reversing valve 141 and the second electromagnetic multi-way reversing valve 142, which can better control the movement of the downhole wheeled tractor 100 in the horizontal well.

Embodiment 2

From FIG. 1, FIG. 4, FIG. 5 and FIG. 6, the present embodiment provides a downhole wheeled tractor 100 and a downhole gas driving traction system which is composed of a ground gas compressor (1), a gas booster pump (2), a gas regulation module (3), a gas recovery station (6), an optical fiber device (8), an optical fiber receiving module (9), a ground optical fiber monitoring module (10), a downhole valve group control module (11) and the downhole wheeled tractor 100; and the downhole wheeled tractor 100 is composed of an optical fiber connector (13), a power unit, traction units 130, a pressure balancing module (33) and an instrument connector (34), wherein the power unit comprises an optical fiber nipple (14), a downhole measurement and control module (17) and a downhole control nipple (21).

An optical transmitter (15) and a PCM electrical transceiver (16) are installed in the optical fiber nipple (14); a downhole pressure sensor (18), a downhole speed sensor (19) and a downhole displacement sensor (20) are installed in the downhole measurement and control module (17); and the downhole control nipple (21) is composed of a liquid storage tank (22), a control module (23) and an exhaust port (24). The control module (23) is composed of a pneumatic liquid booster pump (35), an overflow valve 147, a three-position four-way electromagnetic reversing valve (37), a two-position three-way electromagnetic reversing valve (38) and adjustable one-way throttle valves (39), and the number of the adjustable one-way throttle valves (39) is 2; the adjustable one-way throttle valve B(39*b*) is connected in series with the two-position three-way electromagnetic reversing valve (38), and the adjustable one-way throttle valve B(39*b*) and the two-position three-way electromagnetic reversing valve (38) are connected in parallel with the adjustable one-way throttle valve A(39*a*); and the above three valves, the overflow valve 147 and the three-position four-way electromagnetic reversing valve (37) are connected in parallel. The traction unit 130 is composed of a hydraulic bidirectional motor (26), a transmission mechanism (27), a driving arm 131, a driving wheel 133, a supporting arm 132, a supporting assembly 134 and a hydraulic cylinder (32).

The ground gas compressor (1) is connected with the gas booster pump (2); the gas booster pump (2) is connected with the gas regulation module (3); the gas regulation module (3) transmits the gas to the downhole wheeled tractor 100 through a conveying pipeline A(4); the ground gas compressor (1) provides the gas; the gas is pressurized through the gas booster pump (2); and the gas can adjust the parameters such as pressure of the output gas through the gas regulation module (3). The gas driving system of the downhole wheeled tractor uses an optical fiber for transmission. The optical fiber device (8) extends into the downhole wheeled tractor 100 through the optical fiber (7); the optical fiber device (8) is connected with the optical fiber receiving module (9); and the ground optical fiber monitoring module (10) is connected with the optical fiber receiving module (9) and the gas regulation module (3) through signals. Three sensors as signal sources transmit signals to the optical fiber receiving module (9) through the optical fiber by the PCM electrical transceiver (16) and the optical transmitter (15); and the ground optical fiber monitoring module (10) monitors the data of the downhole wheeled tractor 100. The gas outputted by the ground gas compressor (1) enters the pneumatic liquid booster pump (35) through the air inlet of the pneumatic liquid booster pump (35), so as to drive the hydraulic oil in the liquid storage tank (22) to enter the pneumatic liquid booster pump (35). The gas passes through the exhaust port (24) of the downhole wheeled tractor from the exhaust port of the pneumatic liquid booster pump (35) through the conveying pipe B(5), enters the gas recovery station (6) and is recovered. The downhole valve group control module (11) is connected with the control module (23) through a signal and can control the operating state of a valve group therein. A differential circuit is formed between the two-position three-way electromagnetic reversing valve (38) and the hydraulic cylinder (32). When the two-position three-way electromagnetic reversing valve (38) is not energized, the left cavity of the hydraulic cylinder (32) is filled with hydraulic oil. When the left electromagnetic valve of the two-position three-way electromagnetic reversing valve (38) is powered, then the hydraulic cylinder (32) extends, the two-position three-way electromagnetic reversing valve (38) is powered off and the hydraulic cylinder (32) is recovered. The adjustable one-way throttle valves (39) are installed in an inlet and an outlet of the hydraulic cylinder (32), to play the role of exhaust throttling and adjust the expansion speed of the hydraulic cylinder (32), so as to achieve a better adjustment effect.

In the gas driving system of the downhole wheeled tractor, the downhole wheeled tractor 100 in the system is put into the well. When the lower end of the downhole wheeled tractor 100 enters the horizontal well, the ground gas compressor (1) is started. After the gas is pressurized by the ground gas booster pump (2) and adjusted by the gas regulation module (3), the output gas is conveyed into the downhole wheeled tractor 100 through the conveying pipeline A(4). The pneumatic liquid booster pump (35) converts the pneumatic drive into the hydraulic drive inside the downhole wheeled tractor 100. The gas in the downhole wheeled tractor 100 is recycled into the gas recovery station (6) through the exhaust port (24) in the downhole wheeled tractor 100 by the conveying pipeline B(5). The downhole valve group control module (11) controls the electromagnet of the two-position three-way electromagnetic reversing valve (38) to obtain electricity. The two-position three-way electromagnetic reversing valve (38) starts to operate. The piston of the hydraulic cylinder (32) extends to push the supporting assembly 134 to make linear movement, to drive the supporting arm (30) to expand. The driving wheel (29) is attached to the inner wall of a casing of the horizontal well and moves forward under the action of hydraulic transmission. The hydraulic bidirectional motor (26) can change the direction of rotation through the three-position four-way electromagnetic reversing valve (37), and the hydraulic bidirectional motor (26) can rotate in reverse to retract the downhole wheeled tractor 100. In the process that the downhole wheeled tractor 100 moves in the horizontal well, the downhole pressure sensor (18), the downhole speed sensor (19) and the downhole displacement sensor (20) as signal sources transmit signals to the optical fiber receiving module (9) through the optical fiber by the PCM electrical transceiver (16) and the optical transmitter (15); and the ground optical fiber monitoring module (10) monitors the data of the downhole wheeled tractor 100.

Embodiment 3

Figure 7:
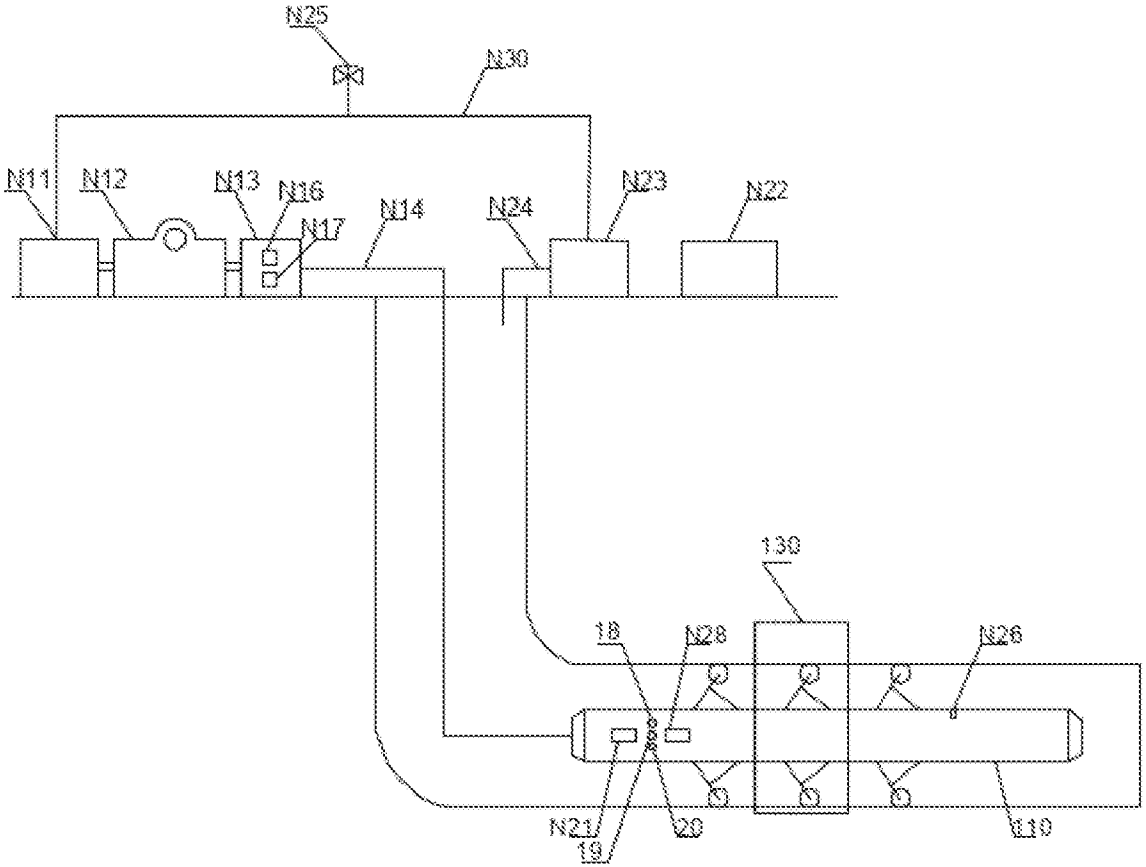
FIG. 7 is a structural schematic diagram of a downhole wheeled tractor which adopts a mud driving system provided by the present application.

By referring to FIG. 7, the present embodiment provides a mud driven downhole traction system, which comprises a mud station N11, a mud pump N12, a ground mud control module N13, a mud conveying pipeline N14 and a downhole wheeled tractor 100.

A mud inlet of the mud pump N12 is communicated with the mud station N11; a mud outlet of the mud pump N12 is communicated with the ground mud control module N13; and both ends of the mud conveying pipeline N14 are communicated with the ground mud control module N13 and the downhole wheeled tractor 100 respectively.

The mud pump N12 is used for pressurizing the mud in the mud station N11 and then delivering the mud to the ground mud control module N13; the ground mud control module N13 is used for controlling the pressure and the flow of the pressurized mud conveyed into the downhole wheeled tractor 100 through the mud conveying pipeline N14; and the downhole wheeled tractor 100 is used for downhole movement under the action of the conveyed pressurized mud.

By referring to FIG. 7, the operating principle of the mud driven downhole traction system is as follows:

The mud driven downhole traction system comprises a mud station N11, a mud pump N12, a ground mud control module N13, a mud conveying pipeline N14 and a downhole wheeled tractor 100; wherein a mud inlet of the mud pump N12 is communicated with the mud station N11; a mud outlet of the mud pump N12 is communicated with the ground mud control module N13; and both ends of the mud conveying pipeline N14 are communicated with the ground mud control module N13 and the downhole wheeled tractor 100 respectively. Thus, the mud can be pressurized by the mud pump N12, and the pressurized mud is pumped into the downhole wheeled tractor 100 to serve as the power source of the downhole wheeled tractor 100.

In this process, the ground mud control module N13 can control the pressure and the flow of the pressurized mud conveyed into the downhole wheeled tractor 100 through the mud conveying pipeline N14, so as to control the downhole traction force and speed of the downhole wheeled tractor 100. Moreover, this control mode can effectively simplify the structure of the downhole wheeled tractor 100, improve the space utilization rate of the downhole wheeled tractor 100, and reduce the use cost of the mud driven downhole traction system.

Further, by referring to FIG. 7, in the present embodiment, when the ground mud control module N13 is arranged in order to control the operating state of the downhole wheeled tractor 100, the ground mud control module N13 may comprise an overflow valve N16 and throttle valves N17; wherein the overflow valve N16 is used for controlling the pressure of the pressurized mud conveyed into the downhole wheeled tractor 100, to control the traction force of the downhole wheeled tractor 100. The throttle valves N17 are used for controlling the flow of the pressurized mud conveyed into the downhole wheeled tractor 100, to control the speed of the downhole wheeled tractor 100.

Thus, through this arrangement, the conveying state of the mud as the power source of the downhole wheeled tractor 100 can be controlled on the ground through the overflow valve N16 and the throttle valves N17, to control the operating state of the downhole wheeled tractor 100, so as to simplify the structure of the downhole wheeled tractor 100, reduce the control difficulty of the downhole wheeled tractor 100, and reduce the control cost of the downhole wheeled tractor 100 through this arrangement.

By referring to FIG. 7, in the present embodiment, the downhole wheeled tractor 100 comprises a tractor body 110, a power unit, and a plurality of traction units N29; wherein the power unit comprises a control valve group N28, a downhole pressure sensor 18, a downhole speed sensor 19, a downhole displacement sensor 20 and a mud continuous wave generator N21. The power unit and the plurality of traction units N29 are connected with the tractor body 110; the plurality of traction units N29 are communicated with the mud conveying pipeline N14 through the control valve group N28; and the control valve group N28 is used for controlling the pressure and the flow direction of the pressurized mud conveyed into the plurality of traction units N29. Thus, the operating states of the plurality of traction units N29 are controlled to control the downhole wheeled tractor 100, that is, to control the opening, advancing, retreating and shrinking movement of the downhole wheeled tractor 100 in the horizontal well.

In the operating process of the downhole wheeled tractor 100, in order to detect the operating state of the downhole wheeled tractor 100 to adjust the traction force and the speed based on the operating state of the downhole wheeled tractor 100, the mud driven downhole traction system further comprises a ground monitoring device N22.

The downhole pressure sensor 18, the downhole speed sensor 19, the downhole displacement sensor 20 and the mud continuous wave generator N21 are connected with the downhole wheeled tractor 100. The downhole pressure sensor 18 is used for detecting the pressure of the downhole wheeled tractor 100, the downhole speed sensor 19 is used for detecting the speed of the downhole wheeled tractor 100, and the downhole displacement sensor 20 is used for detecting the displacement of the downhole wheeled tractor 100.

Moreover, in order to transmit the data of the operating state of the downhole wheeled tractor 100 to the ground to allow the personnel to control the downhole wheeled tractor according to the data of the operating state of the downhole wheeled tractor 100, the mud continuous wave generator 21 is electrically connected with the downhole pressure sensor 18, the downhole speed sensor 19 and the downhole displacement sensor 20, and the mud continuous wave generator N21 is in communication connection with the ground monitoring device N22; and the mud continuous wave generator N21 is used for transmitting the pressure, speed and displacement data of the downhole wheeled tractor 100 to the ground monitoring device N22.

It should be noted that the mud continuous wave generator N21 is used for transmitting signal waveforms to the ground monitoring device N22 by means of mud pulse transmission, and then transmitting the data of the downhole sensors to the ground monitoring module. Thus, the mud simultaneously plays the roles of signal transmission and energy supply drive in the system. The ground monitoring device N22 is decoded to monitor the pressure, speed and displacement data, to allow the personnel to control the traction force and the speed of the downhole wheeled tractor 100 based on the pressure, speed and displacement data of the downhole wheeled tractor 100.

In order to circulate the mud in the mud driven downhole traction system and the horizontal well, the mud driven downhole traction system further comprises a mud recovery station N23 and a mud recovery pipe N24. One end of the mud recovery pipe N24 is communicated with the mud recovery station N23, and the other end of the mud recovery pipe N24 is communicated with the horizontal well; the mud recovery pipe N24 is used for conveying the mud in the horizontal well into the mud recovery station N23; and the mud recovery station N23 is communicated with the mud station N11 through the mud return pipe N30. Moreover, the mud driven downhole traction system further comprises an on-off valve N25, and the on-off valve N25 is arranged on the pipeline that communicates the mud recovery station N23 and the mud station N11. Moreover, along the extension direction of the downhole wheeled tractor 100, one end of the downhole wheeled tractor 100 is connected with the mud conveying pipeline N14, and the other end of the downhole wheeled tractor 100 is provided with a mud discharge port N26. That is, the pressurized mud used by the downhole wheeled tractor 100 can be discharged into the well body through the mud discharge port N26, and the discharged mud is recovered into the mud recovery station N23 through an annulus and the mud recovery pipe N24 to maintain the pressure balance of the downhole wheeled tractor 100. Through this arrangement, under the condition that the mud recovery station N23 and the mud station N11 play a role of storing the mud, the mud recovered in the mud recovery station N23 is supplemented into the mud station N11 in time to ensure that the mud in the mud driven downhole traction system can be recycled.

By referring to FIG. 7, the operating steps of the mud driven downhole traction system are as follows:

The mud driven downhole wheeled tractor 100 is lowered into the horizontal well for operation.

Because the condition of the horizontal well is unknown, the speed and the traction force of the downhole wheeled tractor 100 are not constant. When encountering difficult obstacles, the traction force of the downhole wheeled tractor 100 can be appropriately increased, and the speed of the downhole wheeled tractor 100 can be accelerated under relatively stable conditions. Specifically, in the operation process of the downhole wheeled tractor 100, the ground monitoring device N22 can monitor the traction force and the speed of the downhole wheeled tractor 100 operated in the horizontal well in real time. By adjusting the operating state of the ground mud control module N13, the parameters, such as flow and pressure, of the mud outputted from the ground mud control module N13 can be changed to control the motion state of the downhole wheeled tractor 100.

The control valve group N28 retracts the wheels of the downhole wheeled tractor 100 when the downhole wheeled tractor 100 is retracted.

In conclusion, by referring to FIG. 7, the mud driven downhole traction system has the following advantages:

The mud driven downhole traction system uses the ground mud station N11 to supply energy for the system, so as to avoid installing the motor and the pump in the downhole wheeled tractor 100, thereby greatly saving the cost and improving the space utilization rate of the mud driven downhole traction system.

The mud driven downhole traction system uses the transmission mode of mud pulse transmission to transmit the data of the downhole sensors to the ground monitoring module. The mud simultaneously plays the roles of signal transmission and energy supply drive in the system. The mud station N11 is connected with the mud recovery station N23, which can realize the recycling of the mud.

Under the action of the ground mud control module N13, the speed and the traction force of the wheeled tractor can be controlled.

The above only describes preferred embodiments of the present application and is not intended to limit the present application. For those skilled in the art, various variations and changes can be made to the present application. Any modification, equivalent replacement, improvement, etc. made within the spirit and the principle of the present application shall be included within the protection scope of the present application.

We claim:

1. A downhole traction system, comprising a driving system and a downhole wheeled tractor, wherein the driving system is connected with the downhole wheeled tractor; the downhole wheeled tractor comprises a tractor body, a power unit and a plurality of traction units; the plurality of traction units are arranged along the extension direction of the tractor body; each of the traction units comprises a driving arm, a supporting arm, a supporting wheel, a driving assembly and a supporting assembly; the driving arm and the supporting arm are movably connected with the tractor body; and the supporting wheel is connected with the driving arm and the supporting arm;

wherein the power unit comprises an optical fiber nipple, a downhole measurement and control module, and a downhole control nipple; an optical transmitter and a pulse code modulation (PCM) electrical transceiver are installed in the optical fiber nipple; a downhole pressure sensor, a downhole speed sensor and a downhole displacement sensor are installed in the downhole measurement and control module; and the downhole control nipple is composed of a liquid storage tank, a control module and an exhaust port.

2. The downhole traction system according to claim 1, wherein the power unit comprises a hydraulic power module, a wireless PLC module, and a downhole measurement and control module;

the hydraulic power module is connected with the driving assembly and the supporting assembly through the downhole measurement and control module, and the hydraulic power module is used for conveying pressurized hydraulic oil to the driving assembly and the supporting assembly through the downhole measurement and control module;

the wireless PLC module is electrically connected with the hydraulic power module and the downhole measurement and control module, and the wireless PLC module is used for communication connection with external equipment.

3. The downhole traction system according to claim 2, wherein the driving assembly comprises a first hydraulic bidirectional motor and a mechanical transmission mechanism, the first hydraulic bidirectional motor is connected with the hydraulic power unit, and the mechanical transmission mechanism is in transmission connection with the first hydraulic bidirectional motor and the supporting wheel;

the first hydraulic bidirectional motor is used for driving the supporting wheel through the mechanical transmission mechanism to rotate under the hydraulic drive action of the hydraulic power unit.

4. The downhole traction system according to claim 2, wherein the supporting assembly comprises a second hydraulic bidirectional motor and a supporting and regulating mechanism; the second hydraulic bidirectional motor is connected with the hydraulic power unit; and the supporting and regulating mechanism is in transmission connection with the second hydraulic bidirectional motor and the supporting arm;

the second hydraulic bidirectional motor is used for driving the supporting arm to extend or retract relative to the tractor body through the supporting and regulating mechanism under the hydraulic drive action of the hydraulic power unit.

5. The downhole traction system according to claim 2, wherein the driving assembly is in transmission connection with the supporting wheel; the supporting assembly is in transmission connection with the supporting arm, and the driving assembly and the supporting assembly are connected with a hydraulic power unit;

the driving assembly is used for driving the supporting wheel to rotate under the hydraulic drive action of the hydraulic power unit; and the supporting assembly is used for driving the supporting arm to radially extend along the tractor body under the hydraulic drive action of the hydraulic power unit, so that the supporting wheel connected with the supporting arm is abutted against a well wall, or for driving the supporting arm to radially retract along the tractor body, so that the supporting wheel connected with the supporting arm is stored in the tractor body and not abutted against the well wall.

6. The downhole traction system according to claim 5, wherein the hydraulic power module comprises a hydraulic oil tank, an oil filter, a hydraulic motor and a hydraulic pump; the hydraulic pump is communicated with the hydraulic oil tank through the oil filter, and the hydraulic motor is in transmission connection with the hydraulic pump and is used for driving the hydraulic pump to operate to pressurize the hydraulic oil in the hydraulic oil tank and pump into the downhole measurement and control module.

7. The downhole traction system according to claim 6, wherein the downhole measurement and control module comprises a first hydraulic pipeline, a second hydraulic pipeline, a first electromagnetic multi-way reversing valve, a second electromagnetic multi-way reversing valve, a first check valve and a second check valve;

one end of the first hydraulic pipeline is communicated with the hydraulic pump, and the other end of the first hydraulic pipeline is communicated with P port of the first electromagnetic multi-way reversing valve; T port of the first electromagnetic multi-way reversing valve is communicated with the hydraulic oil tank; and A port and B port of the first electromagnetic multi-way reversing valve are communicated with the driving assembly;

one end of the second hydraulic pipeline is communicated with the hydraulic pump, and the other end of the second hydraulic pipeline is communicated with P port of the second electromagnetic multi-way reversing valve; T port of the second electromagnetic multi-way reversing valve is communicated with the hydraulic oil tank; and A port and B port of the second electromagnetic multi-way reversing valve are communicated with the supporting assembly;

the first check valve is arranged on the first hydraulic pipeline to conduct the first hydraulic pipeline in one direction from the hydraulic pump to the first electromagnetic multi-way reversing valve, and the second check valve is arranged on the second hydraulic pipeline to conduct the second hydraulic pipeline in one direction from the hydraulic pump to the second electromagnetic multi-way reversing valve;

the first electromagnetic multi-way reversing valve and the second electromagnetic multi-way reversing valve are Y-type three-position four-way electromagnetic reversing valves, and the A port and the B port of the first electromagnetic multi-way reversing valve and the second electromagnetic multi-way reversing valve are communicated with the T ports after power failure;

the downhole measurement and control module further comprises a pressure sensor and a flow sensor; the pressure sensor is used for detecting the oil pressure of hydraulic oil outputted by the hydraulic pump, and the flow sensor is used for detecting the flow of hydraulic oil outputted by the hydraulic pump.

8. The downhole traction system according to claim 5, wherein the driving system comprises a ground driving system, a PLC control unit, a cable device and a ground measurement and control device; the ground measurement and control device is electrically connected with the ground PLC control unit; and the ground PLC control unit is electrically connected with the downhole wheeled tractor through the cable device.

9. The downhole traction system according to claim 1, wherein the power unit comprises a control valve group, a downhole pressure sensor, a downhole speed sensor, a downhole displacement sensor and a mud continuous wave generator.

10. The downhole traction system according to claim 9, wherein the driving system is a mud driving system.

11. The downhole traction system according to claim 10, wherein the mud driving system comprises a mud station, a mud pump, a ground mud control module and a mud conveying pipeline; a mud inlet of the mud pump is communicated with the mud station; a mud outlet of the mud pump is communicated with the ground mud control module; both ends of the mud conveying pipeline are communicated with the ground mud control module and the downhole wheeled tractor respectively; the mud pump is used for pressurizing the mud in the mud station and then delivering the mud to the ground mud control module; the ground mud control module is used for controlling the pressure and the flow of the pressurized mud conveyed into the downhole wheeled tractor through the mud conveying pipeline; and the downhole wheeled tractor is used for downhole movement under the action of the conveyed pressurized mud.

12. The downhole traction system according to claim 11, wherein the control valve group and the plurality of traction units are connected with the tractor body; the plurality of traction units are communicated with the mud conveying pipeline through the control valve group; and the control valve group is used for controlling the pressure and the flow direction of the pressurized mud conveyed into the plurality of traction units.

13. The downhole traction system according to claim 11, wherein the ground mud control module comprises an overflow valve and a throttle valve; the overflow valve is used for controlling the pressure of the pressurized mud conveyed into the downhole wheeled tractor to control the traction force of the downhole wheeled tractor; and the throttle valve is used for controlling the flow of the pressurized mud conveyed into the downhole wheeled tractor to control the speed of the downhole wheeled tractor.

14. The downhole traction system according to claim 11, wherein the mud driven downhole traction system further comprises a downhole pressure sensor, a downhole speed sensor, a downhole displacement sensor, a mud continuous wave generator and a ground monitoring device;

the downhole pressure sensor, the downhole speed sensor, the downhole displacement sensor and the mud continuous wave generator are all connected with the downhole wheeled tractor; the downhole pressure sensor is used for detecting the pressure of the downhole wheeled tractor; the downhole speed sensor is used for detecting the speed of the downhole wheeled tractor; and the downhole displacement sensor is used for detecting the displacement of the downhole wheeled tractor;

the mud continuous wave generator is electrically connected with the downhole pressure sensor, the downhole speed sensor and the downhole displacement sensor, and the mud continuous wave generator is in communication connection with the ground monitoring device; and the mud continuous wave generator is used for transmitting the pressure, speed and displacement data of the downhole wheeled tractor to the ground monitoring device;

the mud driven downhole traction system further comprises a mud recovery station and a mud recovery pipe; one end of the mud recovery pipe is communicated with the mud recovery station, and the other end of the mud recovery pipe is communicated with a horizontal well; the mud recovery pipe is used for conveying the mud in the horizontal well into the mud recovery station; the mud recovery station is communicated with the mud station pipeline; and along the extension direction of the downhole wheeled tractor, one end of the downhole wheeled tractor is connected with the mud conveying pipeline, and the other end of the downhole wheeled tractor is provided with a mud discharge port.

15. The downhole traction system according to claim 1, wherein the driving system is a pneumatic gas driving system.

16. The downhole traction system according to claim 15, wherein the pneumatic gas driving system is composed of a ground gas compressor, a gas booster pump, a gas regulation module, a gas recovery station, an optical fiber device, an optical fiber receiving module, a ground optical fiber monitoring module and a downhole valve group control module; the ground gas compressor is connected with the gas booster pump; the gas booster pump is connected with the gas regulation module; the gas regulation module transmits the gas to the downhole wheeled tractor through a conveying pipeline A; the gas driving system of the downhole wheeled tractor uses an optical fiber to transmit measurement and control signals; the optical fiber device extends into the downhole wheeled tractor through the optical fiber; the optical fiber device is connected with the optical fiber receiving module; and the ground optical fiber monitoring module is connected with the optical fiber receiving module and the gas regulation module through signals.

17. The downhole traction system according to claim 16, wherein the ground gas compressor provides a high pressure gas source and pressurizes the gas through the gas booster pump, and the gas regulation module can regulate the pressure and flow parameters of the output gas.

18. The downhole traction system according to claim 16, wherein the downhole pressure sensor, the downhole speed sensor and the downhole displacement sensor as signal sources transmit signals to the optical fiber receiving module through the optical fiber by the PCM electrical transceiver and the optical transmitter; and the ground optical fiber monitoring module monitors the pressure, the speed and the displacement of the downhole wheeled tractor.

19. The downhole traction system according to claim 16, wherein the exhaust port is connected with the gas recovery station through a conveying pipeline B to recover gas; and the traction unit is composed of a hydraulic bidirectional motor, a transmission mechanism, a driving arm, a driving wheel, a supporting arm, a supporting and regulating mechanism and a hydraulic cylinder;

the control module is composed of a pneumatic liquid booster pump, an overflow valve, a three-position four-way electromagnetic reversing valve, a two-position three-way electromagnetic reversing valve and adjustable one-way throttle valves, and the number of the adjustable one-way throttle valves is 2; the adjustable one-way throttle valve B is connected in series with the two-position three-way electromagnetic reversing valve, and the adjustable one-way throttle valve B and the two-position three-way electromagnetic reversing valve are connected in parallel with the adjustable one-way throttle valve A; the adjustable one-way throttle valve A, the adjustable one-way throttle valve B, the two-position three-way electromagnetic reversing valve, the overflow valve and the three-position four-way electromagnetic reversing valve are connected in parallel;

the gas enters the pneumatic liquid booster pump through a gas inlet of the pneumatic liquid booster pump, to drive the hydraulic oil in the liquid storage tank to enter the pneumatic liquid booster pump;

the downhole valve group control module is connected with the control module through a signal, and can control the operating state of a valve group therein; a differential circuit is formed between the two-position three-way electromagnetic reversing valve and the hydraulic cylinder; and the adjustable one-way throttle valves are installed in an inlet and an outlet of the hydraulic cylinder, to play the role of exhaust throttling and adjust the expansion speed of the hydraulic cylinder.

* * * * *